United States Patent [19]

Harvey

[11] 4,239,569

[45] Dec. 16, 1980

[54] HEAT TRANSFER LABELING MACHINE

[75] Inventor: Albert J. Harvey, Fairfield, Ohio

[73] Assignee: Diamond International Corporation, New York, N.Y.

[21] Appl. No.: 955,372

[22] Filed: Oct. 27, 1978

[51] Int. Cl.[2] ..... B65C 3/26; B44C 57/08

[52] U.S. Cl. ..... 156/156; 156/235; 156/238; 156/542

[58] Field of Search ..... 156/156, 538, 540–542, 156/235, 238

[56] References Cited

U.S. PATENT DOCUMENTS

| | | | |
|---|---|---|---|
| 3,111,446 | 11/1963 | Flood | 156/542 |
| 3,139,368 | 6/1964 | Flood | 156/542 |
| 3,415,706 | 12/1968 | Ettre | 156/540 |
| 3,483,063 | 12/1969 | Baines | 156/542 |
| 3,657,053 | 4/1972 | Warsager | 156/156 |

*Primary Examiner*—Douglas J. Drummond
*Attorney, Agent, or Firm*—Kenyon & Kenyon

[57] ABSTRACT

An apparatus for and method of applying heat transferable labels from a web onto a hollow article. The articles to be decorated pass through the apparatus continuously with the label being applied without any stoppage or other intermittent motion imparted to the article being decorated. In this respect, the articles are conveyed to a receptacle holding means which receives and holds the article while passing through the decorating station. The label carrying web, which is driven through the decorating station, is heated both at and prior to the decorating station to facilitate transfer without the necessity of interrupting either the movement of the label carrying web or article to be decorated.

37 Claims, 16 Drawing Figures

HEAT TRANSFER LABELING MACHINE

BACKGROUND OF THE INVENTION

This invention relates generally to a heat transfer labeling apparatus and a method of applying a heat transferable label to a hollow article. More particularly, this invention relates to such an apparatus and method wherein the articles are decorated in a continuous operation.

Numerous decorating techniques are known in the art, some of which include the application of a label onto a hollow article to be decorated. One of the techniques which is desirable in this type of decorating is the usage of a heat transferable label which includes a decorative predetermined design thereon and may thus be transferred onto the article or container being decorated.

The heat transfer process permits for multicolored designs to be applied to a container in a single operation. The heat transfer process involves the use of a release-coated carrier upon which the design to be transferred is printed. The design is transferred from the web-like carrier to the container generally by using a combination of heat and pressure. The principal advantage of the heat transfer technique is that multicolored designs of an infinite variety may be applied to a container.

Because of the heat requirements associated with the release and application of the label from the web onto the container, it has been generally accepted practice to maintain the container in a stationary position, albeit rotatable in the instances of circular containers, during the decorating step. This has resulted in numerous prior art types of apparatus which employ intermittently moving mechanisms which include one to engage and deposit a container at a decorating station. Yet another mechanism engages the container at a decorating station. This latter mechanism must permit relative movement between the container and die to facilitate application of the label onto the container to be decorated. Once the container has been decorated it is removed from the decorating station by yet another mechanism and conveyed to another destination. Each of these functions has required numerous types of moving parts and mechanisms to impart the desired motion and transfer of the container to and from a decorating station.

Because of the intermittent movement associated with such systems, the speed of decoration has been limited. The various movements have curtailed operating speeds and placed heat transfer labeling systems in a limited and low rate of production category. Because the means disclosed herein have eliminated these various undesirable mechanisms, a system has been devised which overcomes the disadvantages of the prior art and provides for a system wherein articles are decorated in a continuous manner.

SUMMARY OF THE INVENTION

Briefly stated, the invention herein disclosed provides an apparatus for continuously applying heat transfer labels carried on an elongated web to individual articles or containers to be decorated. Included in the apparatus is a conveying means which continuously conveys the articles to a decorating station adjacent to which is disposed a plurality of receptacle means suitable for receiving and holding the articles to be decorated as they pass through the decorating station. The receptacle means containing the articles to be decorated are continuously driven at the decorating station at the same speed as which the label carrying web is also driven. Means are provided for heating the labels carried on the web prior to their arrival at the decorating station. At the decorating station, means are provided for engaging and inflating the article as well as means for urging the heated label into engagement with the article to be decorated. Downstream of the decorating station is positioned a further conveying means to carry the decorated articles away from the decorating station.

In one of the embodiments of the invention, a vacuum chamber is disposed beneath the conveying means which itself includes a plurality of openings therein. In this manner a vacuum is applied to the bottom of the article being carried along on the conveying means thus restricting and stabilizing its movement. The article is fed from the conveying means in a spaced relationship into the receptacle means by means of a feedscrew disposed adjacent the conveying means. The feedscrew is provided with a suitable pitch permitting the engagement of the article to be decorated and movement from the conveying means into the receptacle means with the pitch of the feedscrew being synchronized to that of the spacing between receptacle means.

At the decorating station a pair of spaced transfer rollers are provided and adapted to move independently into and out of engagement with the article. The transfer rollers are fabricated from different materials, preferably metal and soft rubber, so that the resilient roller that first engages the label accommodates any surface irregularities in the article being decorated while the metallic roller serves to iron the label onto the decorated article. Because each of the rollers is operated at a different temperature, the label is initially heated to a temperature sufficient to cause transfer of the label to the article being decorated with the heat of the second roller being higher than that of the first so as to cause the release of the label from the label carrying web and complete the transfer of the decorative label onto the article being decorated.

The resilient transfer roller is mounted in a heated housing both of which are pivotally movable into and out of engagement with the article although remaining in contact with the label carrying web. The metallic transfer roller is mounted to a pivotal arm member, with the movement of each of the rollers being controlled by a separate cam member. In this respect, each transfer roller has associated therewith a rotatable cam member that is in operative engagement with a cam follower which in turn has the fixed end thereof coupled to the transfer roller. Thus, rotation of each cam causes an inward and outward movement of the respective transfer roller. The cams are of generally identical shapes but positioned out of phase with one another so that each roller sequentially engages the article being decorated. A biasing spring is further provided for each of the pair of transfer rollers to urge the rollers out of engagement with the web until such time as the cam follower engages a predetermined portion of the cam which is designed to move the respective transfer roller into engagement with the article.

A variable speed drive motor is provided to drive the rotatable cams which are mounted on a common shaft. The same drive motor is operatively coupled to the label carrying web drive means whereby the movement of the cam operated transfer rollers is synchronized to the speed of the label carrying web routed through the decorating station.

As mentioned, the resilient transfer roller is mounted in a pivotally movable heater housing. Such housing has the upstream end thereof pivotally mounted thus enabling the resilient transfer roller to move into and out of engagement with the label carrying web. Further, such positioning facilitates the initial roller engagement with the web to be the resilient roller with the metallic roller engaging the web subsequent thereto by operation of an independent cam member.

The first or rubber roller is heated to a surface temperature of approximately 130°-250° F. so as to cause the transfer of the label onto the article being decorated. The second metallic roller is preferably made of a chrome plated copper material and heated to a temperature of approximately 500°-600° F. In this manner, the second roller effects the release of the label from the web and serves to iron the label onto the article being decorated.

In those instances where the article to be decorated has a taper or otherwise irregular side wall, such as a tapered oval bottle, additional cam members are provided to control the movement of the transfer rollers. Specifically, each roller movement is controlled by a cam member engaging the upper portion thereof and another cam member engaging the lower portion of the roller. Thus, by appropriate cam design, movement of the top and bottom portions of the roller is independently controlled and articles having different upper and lower shapes or sizes may be decorated.

Means are further provided to regulate and maintain the degree of tension of the label carrying web as it travels to the decorating station from a supply wheel. In this respect, a movable roller is provided over which the label carrying web passes. An arm connected to the movable roller serves to activate a switch disposed therebeneath in a predetermined position. Upon activation by the movement of the arm, the switch generates a signal which activates a braking member associated with the supply reel. In this manner, movement of the roller serves to regulate and maintain constant the tension on the web being metered from the supply reel. The switch is preferably magnetically operated by movement of the arm. Further, a spring biasing means is connected to the roller supporting arm tending to maintain tension on the web.

Preferably, the apparatus is provided in modular form, with identical but oppositely disposed modules forming a system for decorating two different sides of an article including non-symetrically shaped articles. With each module delivering a separate label carrying web to the decorating station, simultaneous decoration of opposite sides of an article is accomplished. Moreover, different labels may thus be applied to the article. The label carrying webs are routed through the decorating station spaced at a distance from one another approximately equal to that of the width of the article to be decorated. The articles are conveyed adjacent to the decorating station and carried between the oppositely disposed label carrying webs. Each module may be independently driven with the respective drive motors coupled to one another to synchronize the speeds of the respective webs. Also, frame or module adjustment means may be provided for each module to enable tilting of the system so as to accommodate decoration of articles having tapered sidewalls.

Additional features of the invention relate to the receptacle means, an article supporting belt disposed adjacent the decorating station, air inflating means, web and article registration means and the manner of feeding the label carrying web to the decorating station. Although each of these several features are included in the overall apparatus and method of operating the apparatus as disclosed herein, certain of the details are disclosed in related co-pending applications. Specifically, reference is made to the disclosures in my co-pending applications entitled ARTICLE INFLATING SYSTEM and ARTICLE SUPPORT SYSTEM, Ser. Nos. 955,370 filed Oct. 27, 1978 and 955,317 filed Oct. 27, 1978, respectively, the disclosures of which are herein incorporated by reference.

Accordingly, it is an object of this invention to provide an effective and reliable means for accomplishing high speed heat transfer label decoration.

It is another object of this invention to provide a labeling apparatus in which the articles to be decorated are continuously moved within the apparatus and decorated therein without any intermittent or other interruption of movement.

It is still another object of this invention to provide an apparatus for accurately positioning and transferring heat applied labels onto the hollow containers including those of irregular shape.

These, and other objects and features of the invention will become more apparent from the following description taken in conjunction with the accompanying drawings.

BRIEF DESCRIPTION OF THE DRAWING

FIG. 13 is a top, plan view illustrating both sides of a container being decorated at the decorating station;

FIG. 16 is a perspective view of a cam operated transfer roller suitable for decorating a tapered oval bottle.

DESCRIPTION OF THE PREFERRED EMBODIMENT

Figure 1:
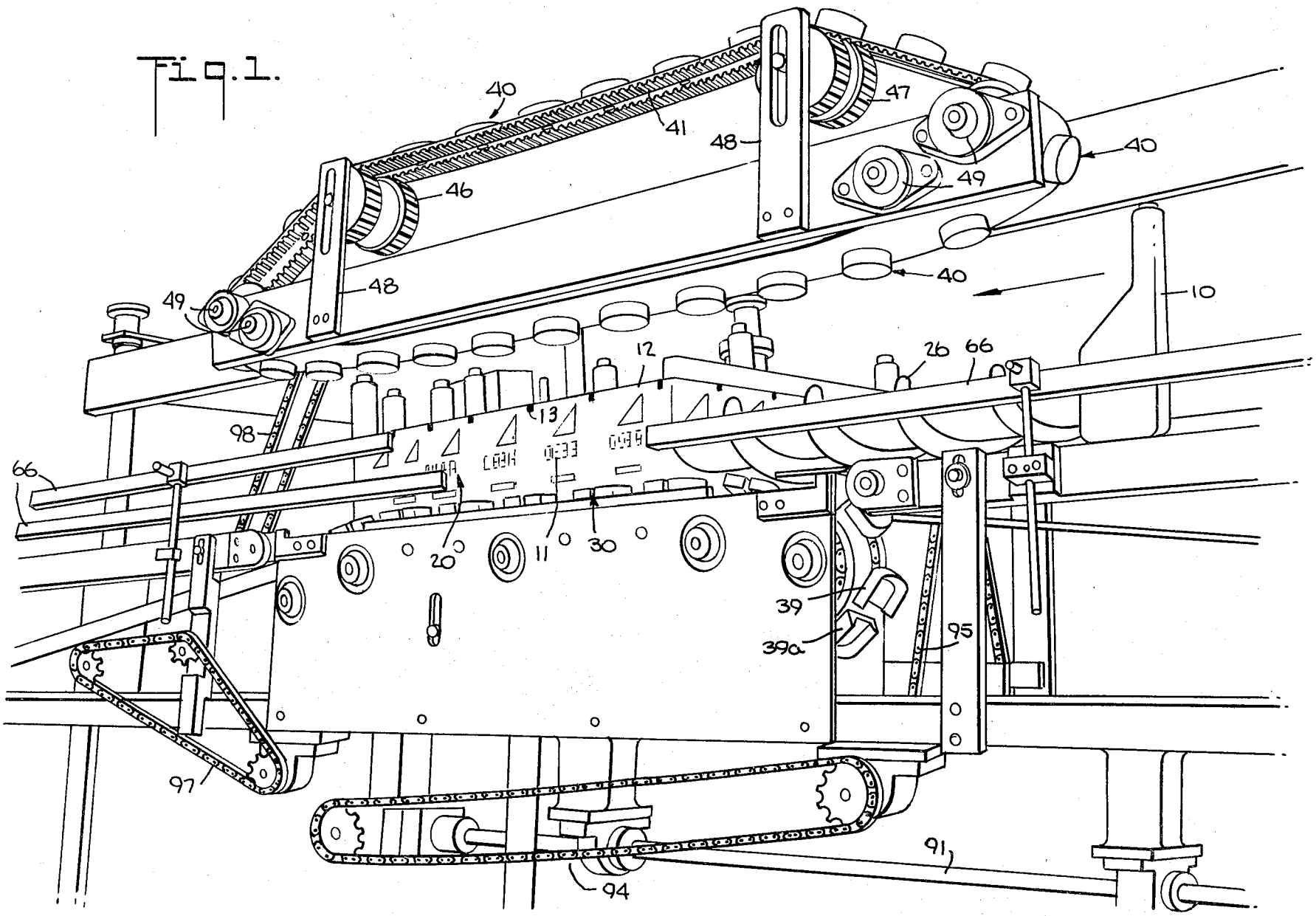
FIG. 1 is a front perspective view of the heat transfer labeling apparatus of this invention.
Figure 2:
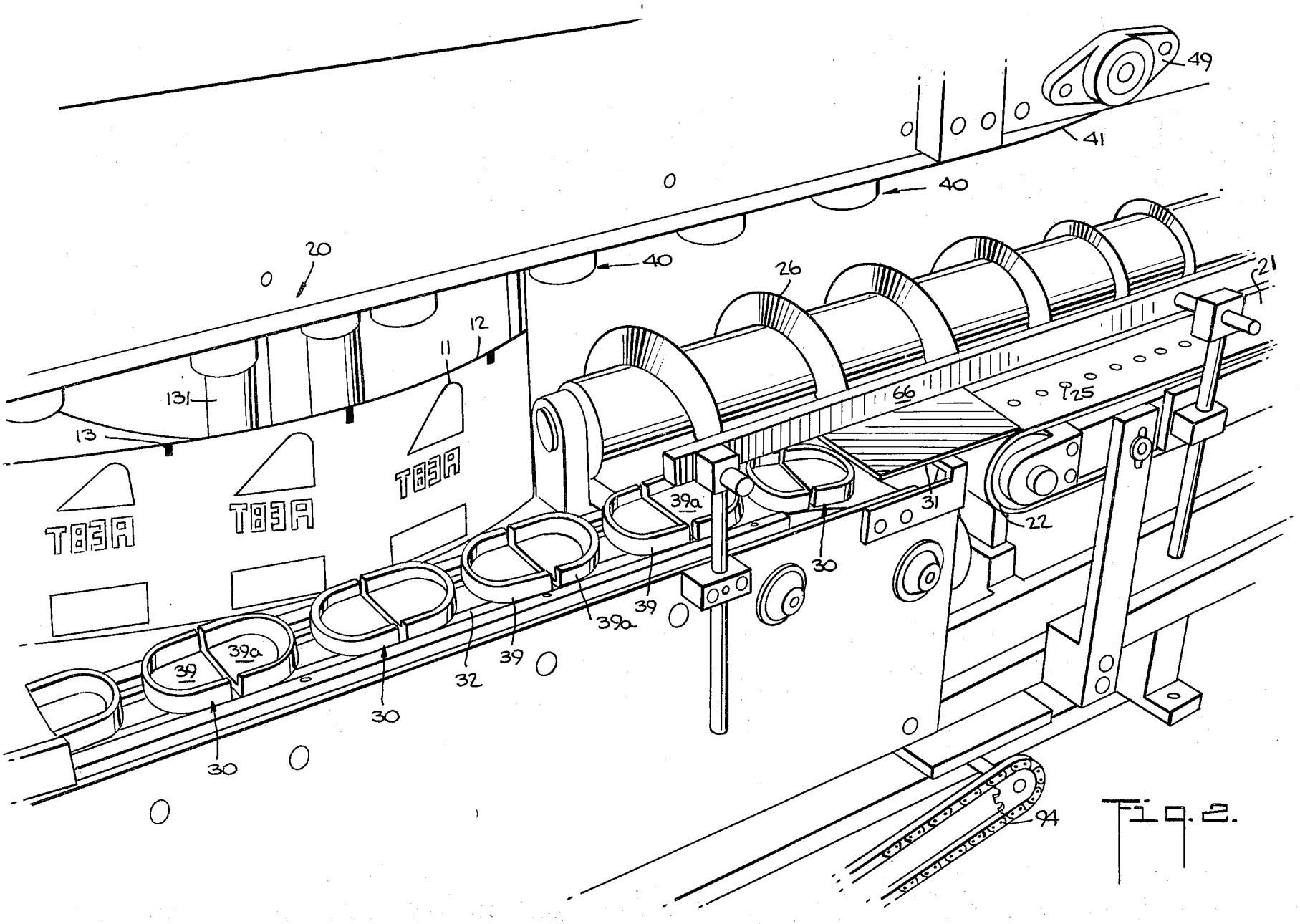
FIG. 2 is an enlarged front perspective view of the decorating station of the apparatus of this invention.
Figure 3:
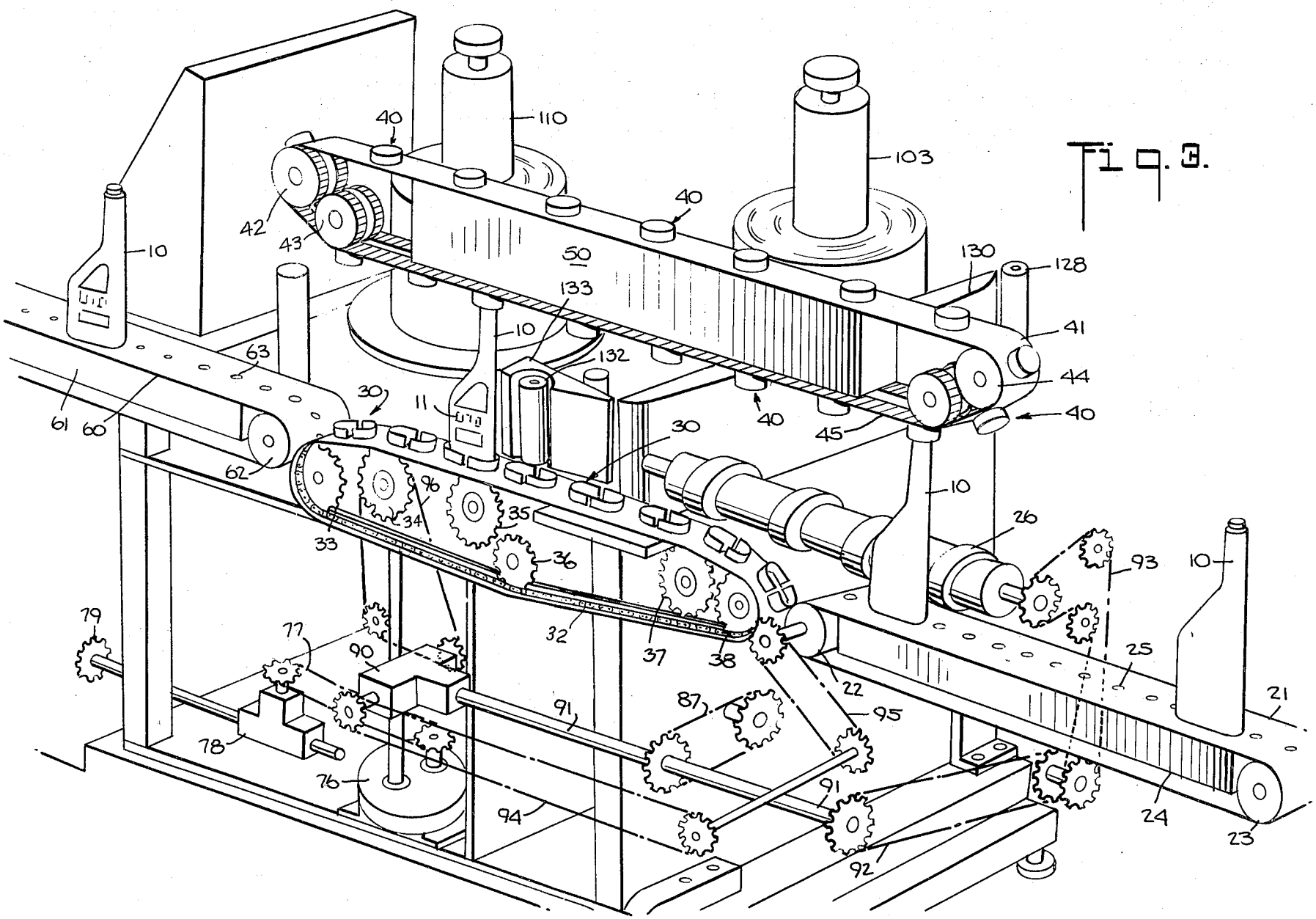
FIG. 3 is a front perspective view of the heat transfer labeling machine of this invention similar to FIG. 1, with certain cover plates and the like removed.

With reference to the drawings, particularly FIGS. 1–3, the article to be decorated by the heat transfer labeling apparatus of this invention is illustrated in the form of an irregular shaped container 10. The container 10 is moved in the direction of the arrow (FIG. 1) to a decorating station indicated generally at 20 at which a label 11 is applied. Label 11 is carried to decorating station 20 by a release coated carrier web 12 which includes thereon a plurality of spaced labels 11 and registration marks 13 disposed between labels on the top portion of web 12.

Container 10 is conveyed toward the decorating station 20 by an endless belt 21 which passes over drive wheels 22 and 23. Mounted within the endless belt 21 is a vacuum chamber 24 which has its upper surface in engagement with the inside portion of the belt 21. Disposed in the center of the belt 21 are a plurality of spaced apertures 25 which permit a vacuum to be applied to the bottom of the container 10 thus holding and stabilizing the container during conveyance. Disposed adjacent to the end portion of belt 21 is a feedscrew 26 which has a pitch suitable for engagement with the particular size container 10. The container 10 is engaged by the threaded portion of screw 26 and fed to a receptacle holding means 30. To facilitate feeding of container 10 into receptacle holding means 30, is a horizontal transfer plate 31 disposed at the end of belt 21 to assist in transposing the container from the conveyor belt 21 into the receptacle 30.

Figures 9, 10:
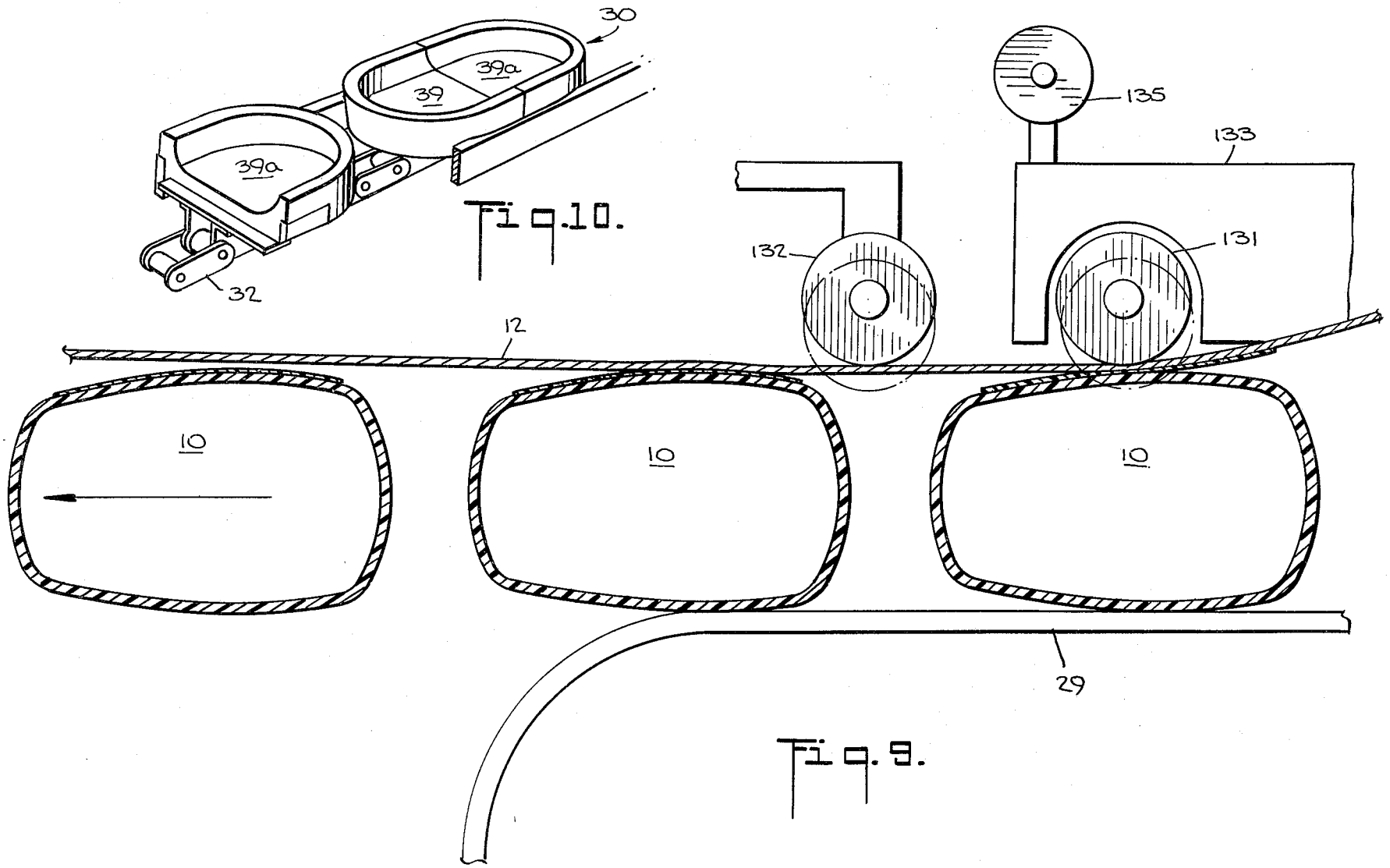
FIG. 9 is an enlarged plan view of the article decorating station.
FIG. 10 is a fragmentary enlarged perspective view of the receptacle holding means.
Figure 11:
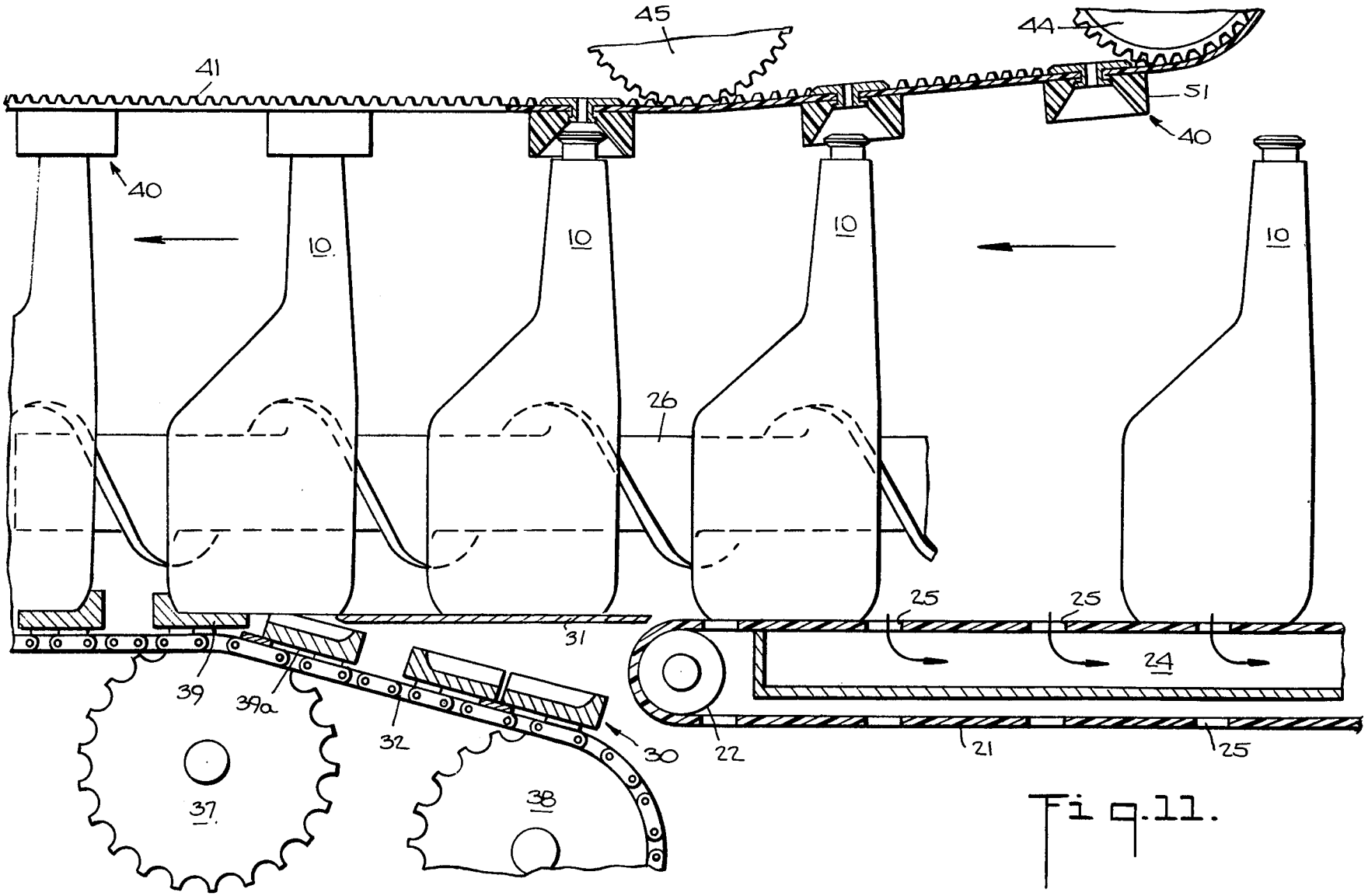
FIG. 11 is an enlarged, front elevation view illustrating containers entering the decorating station.

Receptacles 30 are fastened to an endless chain 32 which is driven over sprockets 33, 34, 35, 36, 37 and 38. Chain 32 is a link type to which the receptacle 30 is fastened. Receptacle 30 consists of split halves 39 and **39*a* (FIG. 10) which have a deep dish contour which substantially matches the bottom portion of the container 10 being decorated. The container 10 is fed by feedscrew 26 into the receptacle 30 with the leading bottom edge of the container engaging the leading or forward half 39 of the receptacle 30 (see FIG. 11). As the container moves forward and while still engaged with the feedscrew 26, chain 32 moves over sprocket 37 with the trailing half 39*a* of the receptacle 30 moving up and into holding engagement with the bottom of the container 10**. Further details are disclosed in my copending application Ser. No. 955,317, entitled ARTICLE SUPPORT SYSTEM.

While the lower portion of container 10 is being moved into receptacle 30, the upper open portion of the container is moved into engagement with a cup-shaped inflating nozzle 40. A plurality of spaced nozzles 40 are fastened to a timing belt 41 which passes over gears 42, 43, 44 and 45, each of which has external teeth matching those provided on the interior of timing belt 41. Also, drive gears 46 and 47 (FIG. 1) engage timing belt 41 and are mounted in adjustable support members 48 which permit adjusting the tension of timing belt 41. The remaining gears 42 through 45 are suitably mounted in bushings 49. Disposed between the upper and lower portions of timing belt 41 is a manifold 50 to facilitate inflating container 10 while at the decorating station 20.

Figure 12:
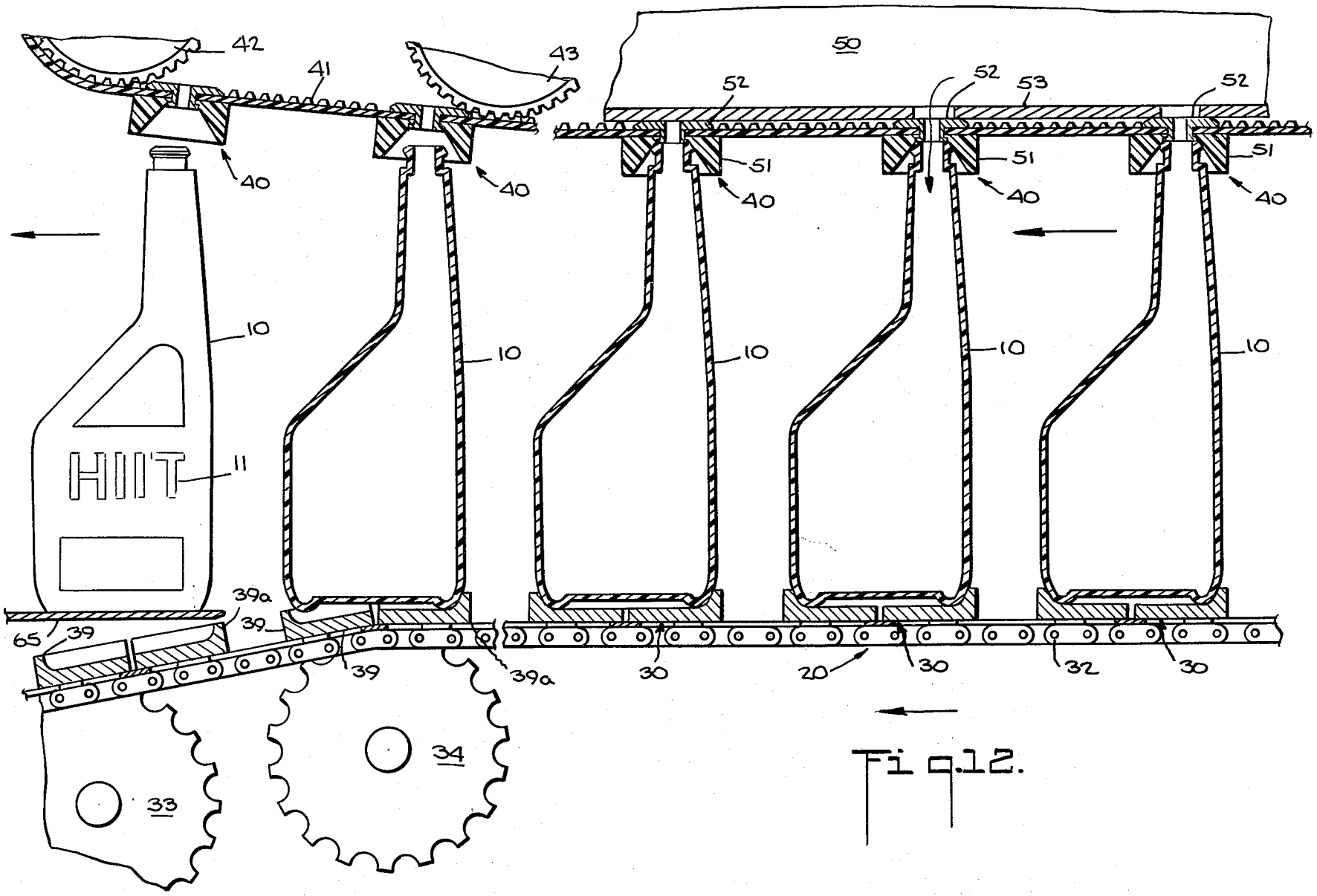
FIG. 12 is an enlarged, front elevation view illustrating containers at and leaving the decorating station.
Figure 18:
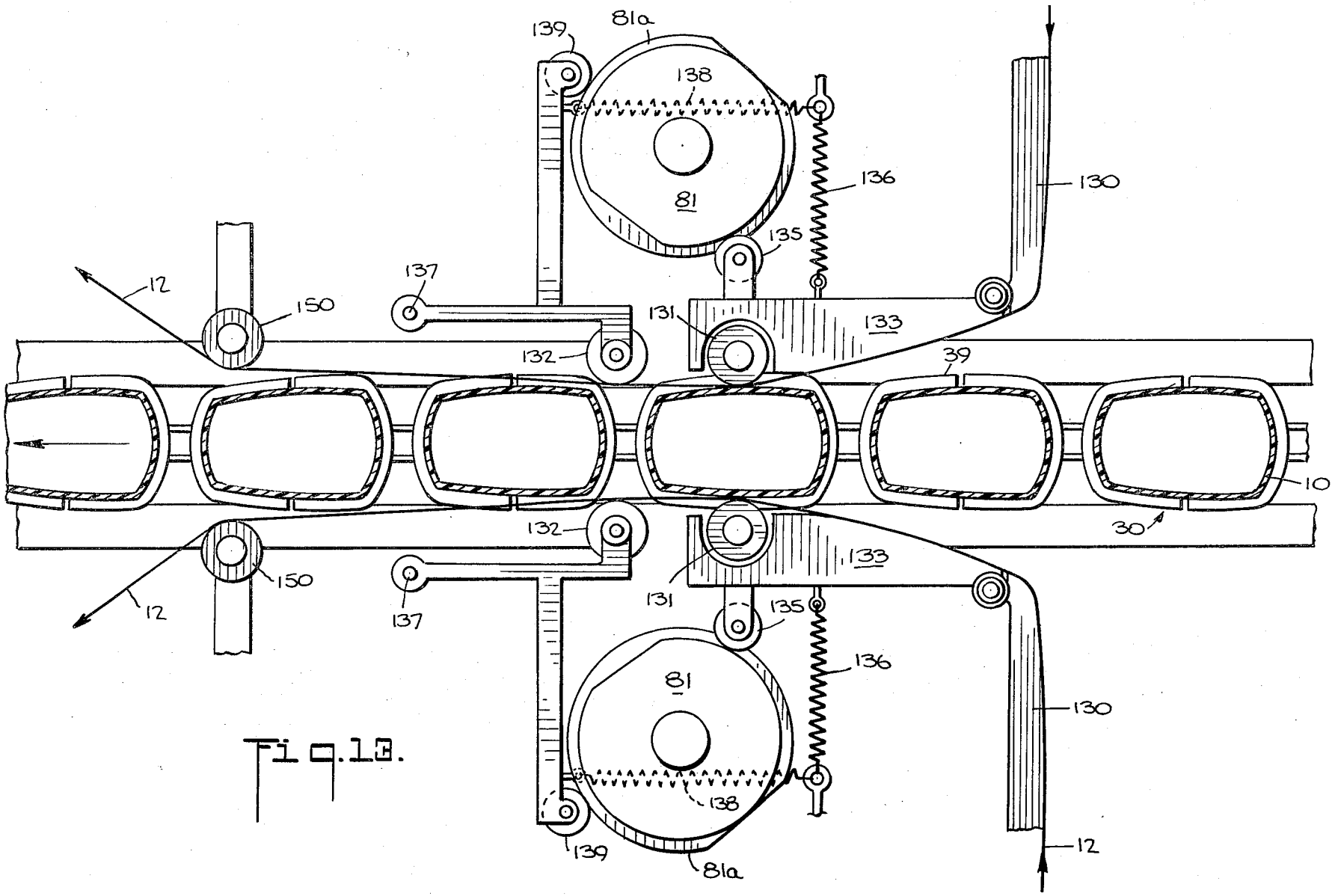

A plurality of cup-shaped nozzles 40 are spaced from one another on timing belt 41 and include a container engaging portion 51. (FIG. 12) The center portion of cup 51 is recessed and of a size compatible for engaging the top opening of the container 10. Cup 51 is preferably fabricated from a nylon material. Bushing 52 is threaded into the center of cup portion 51 and serves to fasten the cup to timing belt 41. In order to permit passage of the rearward extending portion of bushing 52, gears 42–47 are recessed and do not engage the center portion of timing belt 41 which is similarly recessed. Bushing 52 has a circular shaped rearwardly extending portion which has a diameter just slightly less than the width of a groove provided in the lower portion of manifold 50. In this manner, the groove serves as a guide when timing belt 41 is in engagement with the lower portion of manifold 50. Air is thus permitted to enter the container 10 while at the decorating station 20. For further details of the inflating system, reference is made to my copending application Ser. No. 955,370, entitled ARTICLE INFLATING SYSTEM.

Supports 66 are provided for guiding the containers 10 as they travel on input and exit conveyors 21 and 60. Also, when only one side of a container is being decorated further support may be provided for containers 10 while at the decorating station by providing a vertically oriented endless belt 29 for engaging and supporting the side of the bottle not being decorated (see FIG. 9).

Once the container leaves decorating station 20, at which label 11 was applied, it is routed onto exit conveyor 60. A vacuum chamber 61 is also disposed between the upper and lower surfaces of conveyor belt 60 which is driven about wheel 62 and a similar one disposed at the other end thereof. Belt 60 contains slots 63 in the center portion thereof to permit the application of a vacuum to the lower portion of the container 10. Container 10 is discharged from the receptacle 30 as the leading portion 39 moves downward and out of engagement with container 10 after the receptacle passes over sprocket 34. While the trailing half **39*a* of the receptacle 30 is still in engagement with the container, the forward portion of container 10 is moved onto plate 65 (FIG. 12) which is disposed between endless chain 32 and exit conveyor 60. While on plate 65, movement of container 10 is controlled by the trailing container which tends to push the container onto plate 65 and then conveyor 60. As the receptacle 30 drops out of engagement with the container, inflating nozzle 40 is similarly disengaged from the open top portion of container 10. As each nozzle 40 passes over gear 43, it is moved in an upward direction towards the next pulley 42. This thus causes the recessed portion of nozzle 40 to lift out of engagement from container 10. The decorated bottle which exits from conveyor 60** is then ready for filling or other further processing. It is noted that the speeds obtainable with the heat transfer labeling apparatus of this invention (over 200 labels per minute) make the equipment suitable to serve as an in-line piece of equipment along with filling machines and associated equipment.

Figure 4:
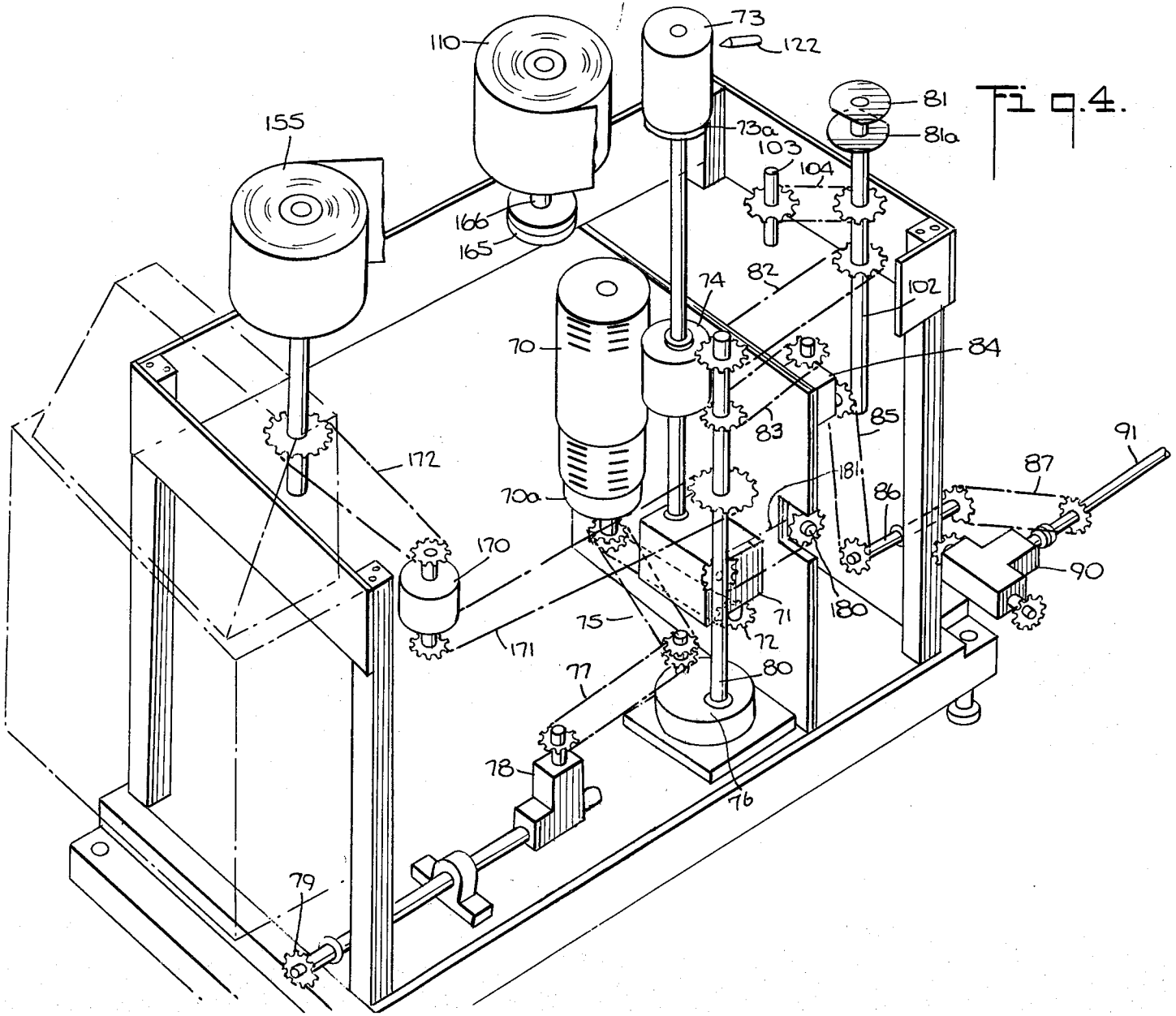
FIG. 4 is a perspective view illustrating the drive controls of the apparatus of this invention.
Figure 5:
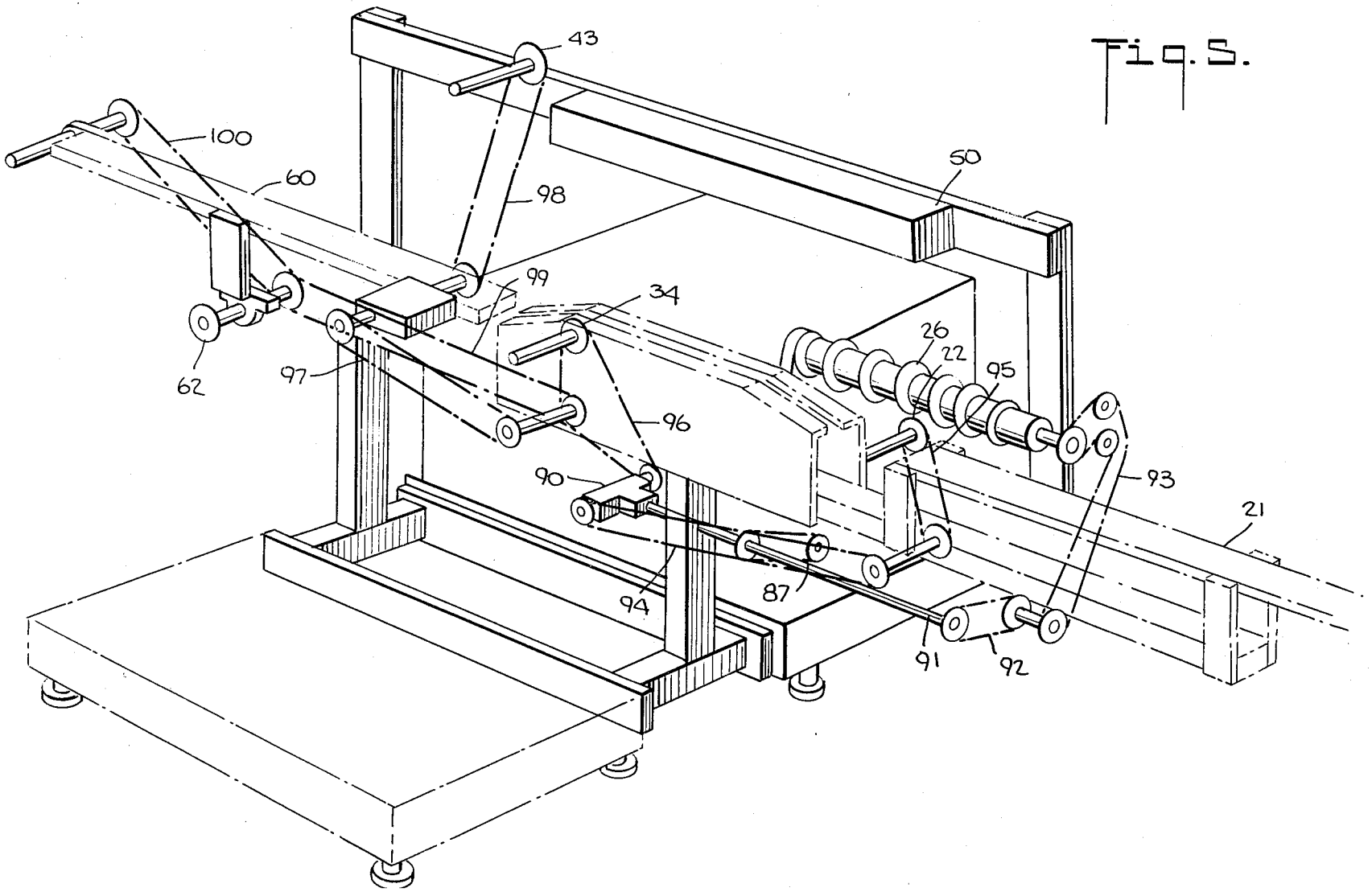
FIG. 5 is a front perspective view illustrating additional drive controls employed in the apparatus of this invention.
Figure 14:
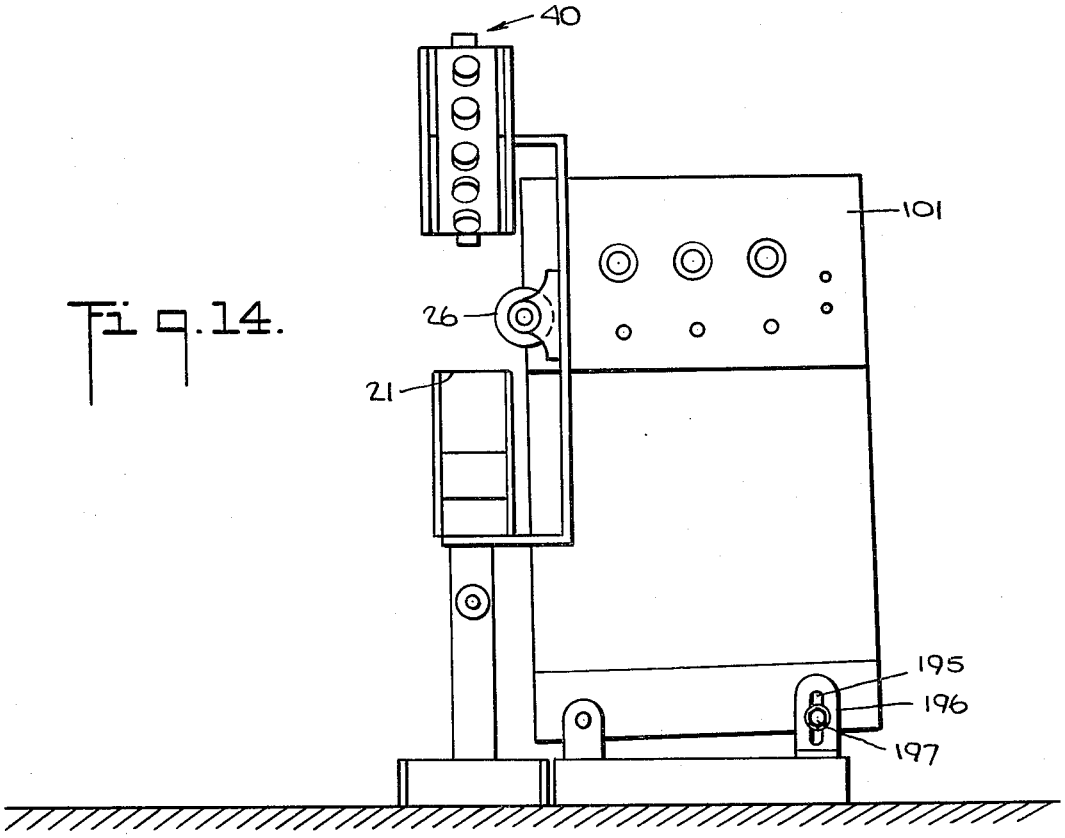
FIG. 14 is a side elevation view of the heat transfer labeling machine of this invention.
Figure 15:
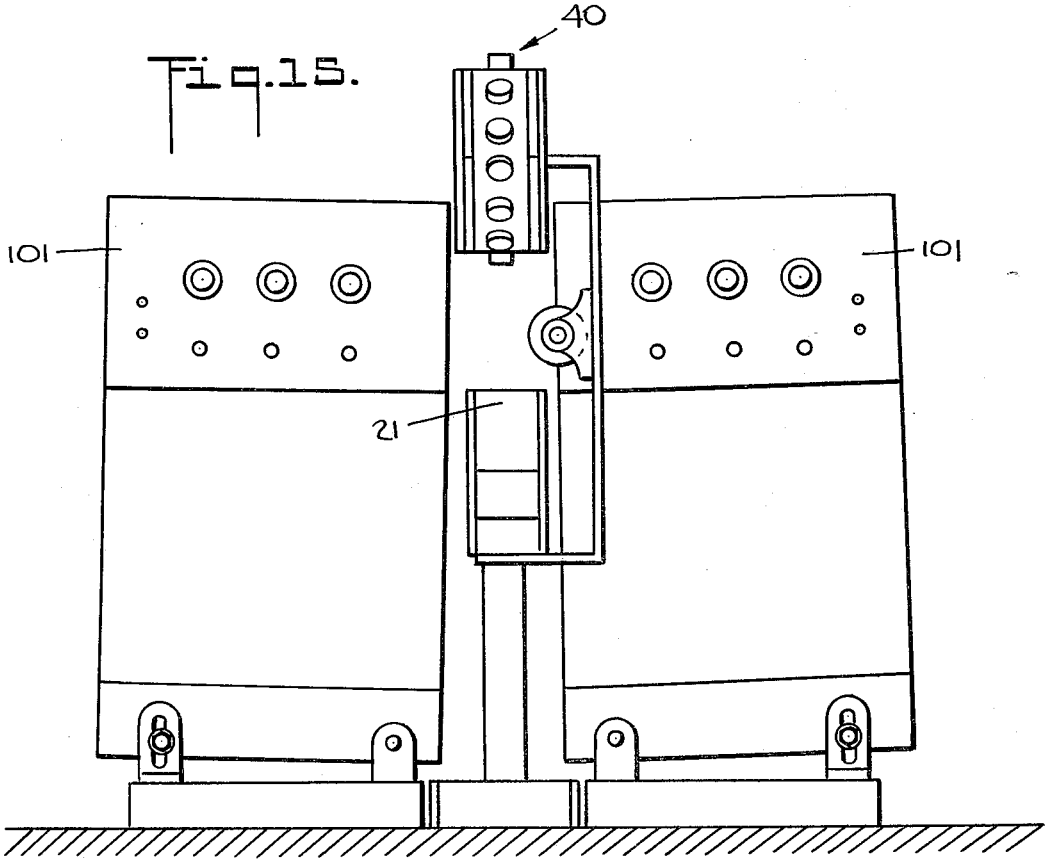
FIG. 15 is a side elevation view of adjacently spaced modules for decorating both sides of a container.
Figure 18:
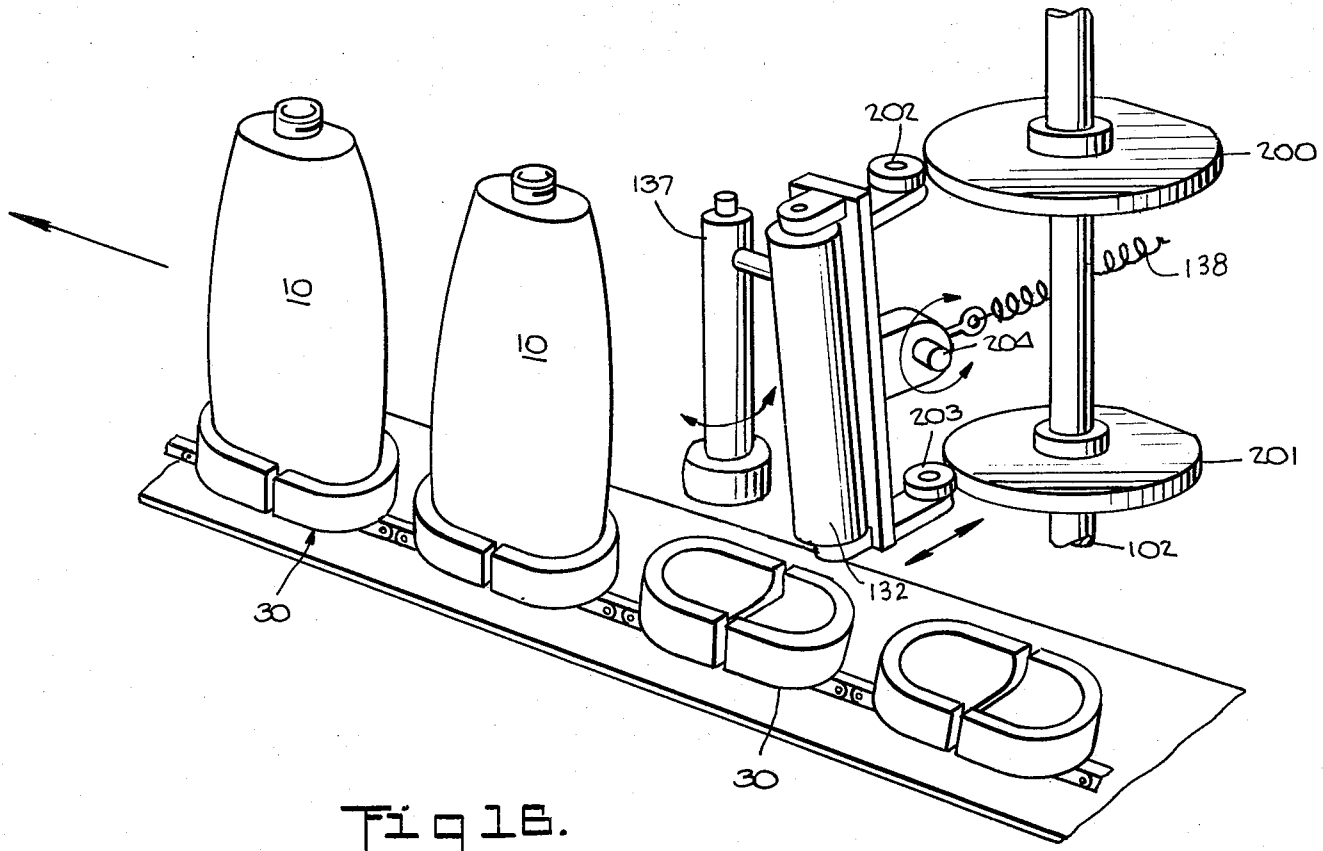

The drive system for the various conveyors will be described with particular reference to FIGS. 4 and 5. A variable speed DC drive motor 70 is provided in each module to drive the article and label moving members. Motor 70 is continuously operated and as required, engaged and disengaged from the drive system by means of a clutch **70*a*. The output of drive motor 70 is transmitted to a mechanical speed controller gear box 71 by means of chain and sprocket drive 72. Output from the mechanical gear box 71 drives a web metering roll 73, the output drive shaft including thereon a clutch-brake 74. Another output from the drive motor 70 is coupled by chain and sprocket drive 75 to gear box 76. Also, by means of chain and sprocket coupling 77** which is connected to a right angle gear box 78, drive motor 70 is mechanically coupled to a similar drive motor of an adjacently spaced module. The adjacently spaced module is identical to the one herein described and as will be described later, is utilized to decorate two sides of the same article (FIGS. 14 and 15). Sprocket 79 is mechanically connected to a similar sprocket on an adjacent module, thus providing a direct mechanical linkage of the DC drive motors 70.

Output shaft 80 from the gear box 76 drives the transfer roller cams 81 and 81*a* mounted on a common shaft by means of the chain and sprocket drive 82. Cams 81 and 81*a*, and the manner in which they serve to drive the label transfer rollers, will be more fully described hereinafter. Another chain and sprocket drive 83, connected to output shaft 80, drives gear box 84 which in turn has its output driving the chain and sprocket 85. Shaft 86 is driven at one end by chain and sprocket 85 while another chain and sprocket drive 87 is thereby driven to provide an input drive to gear box 90 which in turn is employed to drive the various conveying mechanisms. In this respect, shaft 91 in addition to driving gear box 90 has its output at the other end coupled to the feedscrew 26 via chain and sprocket drives 92 and 93. The conveyor 21 is driven by drive wheel 22 which is driven from one output of the gear box 90 by means of chain and sprocket drives 94 and 95. Gear 43 drives the inflating nozzle timing belt 41 with gear 43 being driven by the same output from gear box 90 as is sprocket 34 for driving receptacle chain 32. Sprocket 34 for chain link belt 32 is driven by the chain and sprocket drive 96 coupled to the output from gear box 90 whereas gear 43 is driven therefrom via chain and sprocket drives 97 and 98. Also driven from the same output of gear box 90 is discharge conveyor belt 60 which is driven by the chain and sprocket 96 which in turn is coupled to the chain and sprocket 99 which drives the chain and sprocket 100. Thus is provided a synchronized conveying system for continuously carrying articles 10 through the apparatus with the various speeds regulated while driven from a single source.

Figure 7:
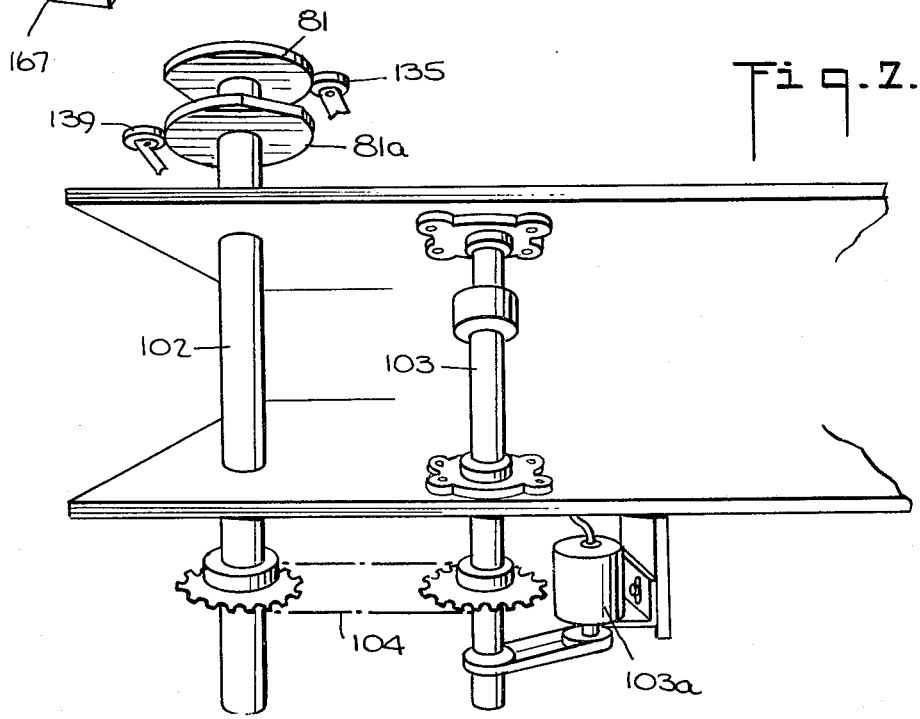
FIG. 7 is a front elevation view of the transfer roller cams and timing means.
Figure 8:
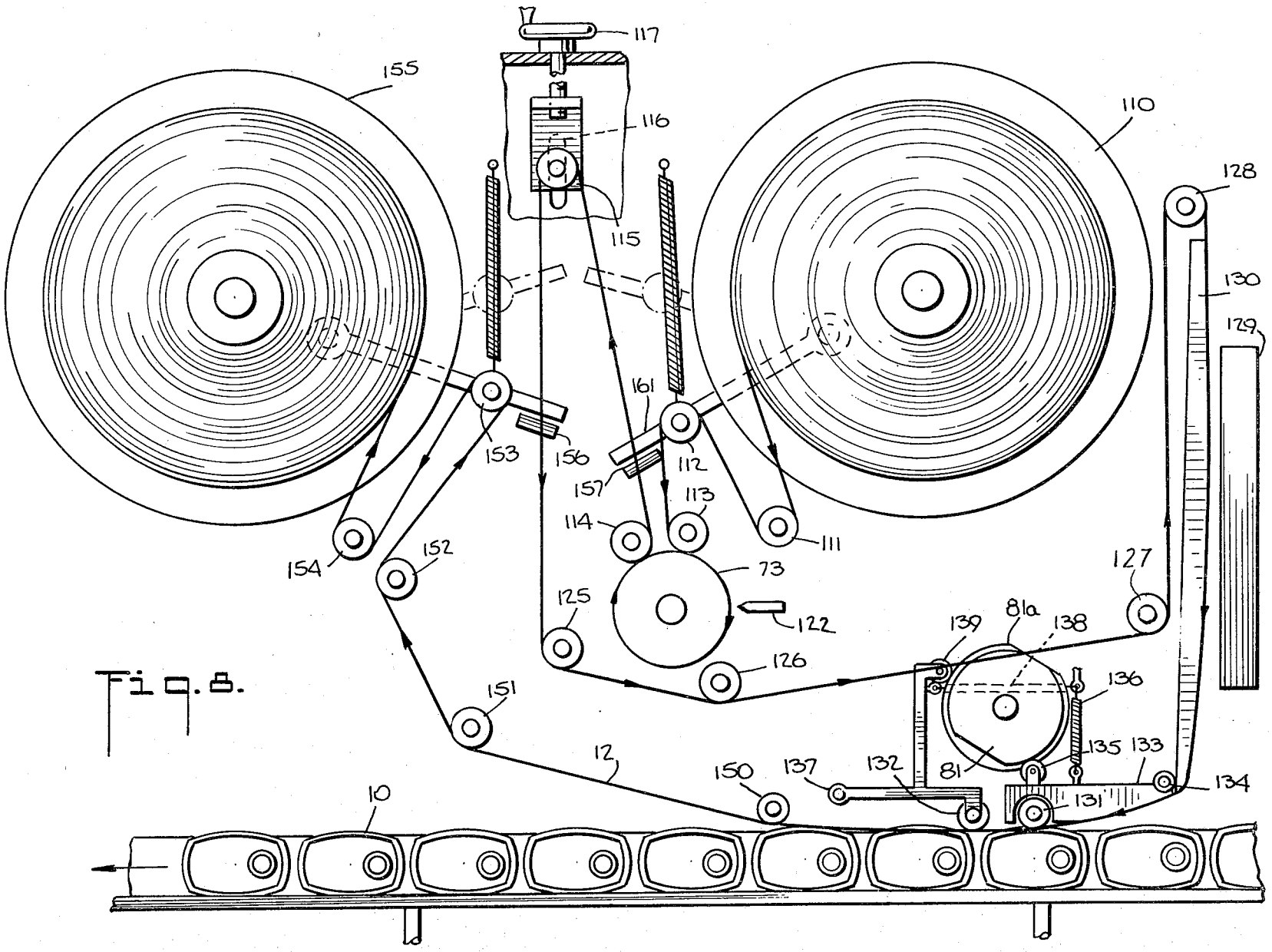
FIG. 8 is a plan view of the label carrying web path through the apparatus of this invention.

Further driven from the same DC variable drive motor 70 is the label carrying web 12. With reference to FIGS. 4 and 8 a control panel 101 is provided on the module (FIGS. 14 and 15) to regulate the speed of the motor 70 which as previously mentioned, drives the web metering roller 73 through the clutch-brake 74 and gear box 71. Transfer roller cams 81 and 81*a* are driven directly from the main motor via gear box 76, shaft 80 and chain and sprocket drive 82 which is connected to shaft 102. The output of shaft 102 also drives shaft 103 through the chain and sprocket arrangement 104. Tachometer 103*a* (FIG. 7), driven off shaft 103, reads the operating speed of the machine and provides a visual display on module panel 101.

The supply of new labels is provided on supply wheel 110, the dispensing of which is regulated by metering roll 73. The web 12 as it is unwound from supply reel 110 passes over idler roller 111 and then over dancer roll 112, the operation of which will be more fully described below. The web next is routed to feed roller 113 and then into the web metering roller 73 adjacent to which a photocell 122 is disposed. Photocell 122 is disposed to be in a position capable of reading registration marks 13 and thus control the web feed speed. Web 12 encircles web metering roller 73 and is fed therefrom through pinch roller 114 over adjustable roller 115. The supply of labels on web 12 is fed by the metering roller 73 which has pinch roller 114 adjusted so as to press against it with the feed dispensed by the metering roll 73 being regulated by an associated brake 73*a*. Metering roll 73 also has an electric clutch-brake 74 which is activated by a photocell (not shown) disposed adjacent the decorating station 20 which in turn determines the presence or absence of a container at the decorating station. Thus, if no article is present to be decorated, clutch 74 disengages metering roller 73 and terminates feeding of web 12.

Adjustable roller 115 is manually movable in slot 116 by means of the rotatable handle 117. This manual adjustment permits for approximate label positioning on the container prior to operation of the machine.

The web being fed by metering roller 73 next passes over idler rollers 125, 126, 127 and 128 and is then routed to pass over the elongated preheat plate 130 which is electrically maintained at a temperature of approximately 200° F. In addition, radiant heater 129 is disposed facing the opposite face of the web 11 so as to further preheat the label prior to arrival at the decorating station 20. At decorating station 20 are disposed a pair of heated transfer rollers 131 and 132 whch are adapted to facilitate transfer of the label 11 onto article 10. Transfer roller 131 has the outer label engaging surface formed of a silicone rubber material of 35 durometer hardness which is heated to a surface temperature of approximately 130°-250° F. The interior of transfer roller 131 is iron oxide filled to provide suitable conductivity. In this manner, transfer roller 131 is maintained at a temperature sufficient to cause transfer of the label 11 to the article 10. Transfer roller 132 is metallic, preferably copper, having a layer of chrome plating on the surface. Transfer roller 132 is heated to a surface temperature of approximately 500°-600° F. so as to effect release of the label 11 from the web 12.

The transfer rollers 131 and 132 are each pivotally mounted and in operative engagement with cams 81 and 81*a* so as to sequentially regulate movement of the transfer rollers into and out of engagement with the article 10 as it arrives at decorating station 20. Cams 81 and 81*a* are mounted on a common shaft 102 which as previously mentioned is driven directly from the drive motor 70.

Transfer roller 131 is mounted in heated housing 133 which is pivotally mounted at 134. A cam follower 135 in engagement with upper cam 81 controls the article engaging and disengaging movement of the roller 131. A spring 136, urges transfer roller 131 and heated housing 133 out of engagement from article 10 except when moved into engagement by means of cam 81. Transfer roller 132 is similarly pivotally mounted at 137 and has spring 138 urging the roller out of engagement from web 12. A cam follower 139, coupled to transfer roller 132, engages lower cam 81*a* which thus controls movement of the metallic transfer roller 132.

Web 12 as it leaves decorating station 20 passes over idler rollers 150, 151 and 152. The web next passes over dancer roll 153 and then over idler roller 154 onto the rewind reel 155. Disposed adjacent the rewind reel 155 and beneath dancer roll 153 is a proximity switch 156, a similar switch 157 being disposed adjacent supply reel 110 and beneath dancer roll 112.

Figure 6:
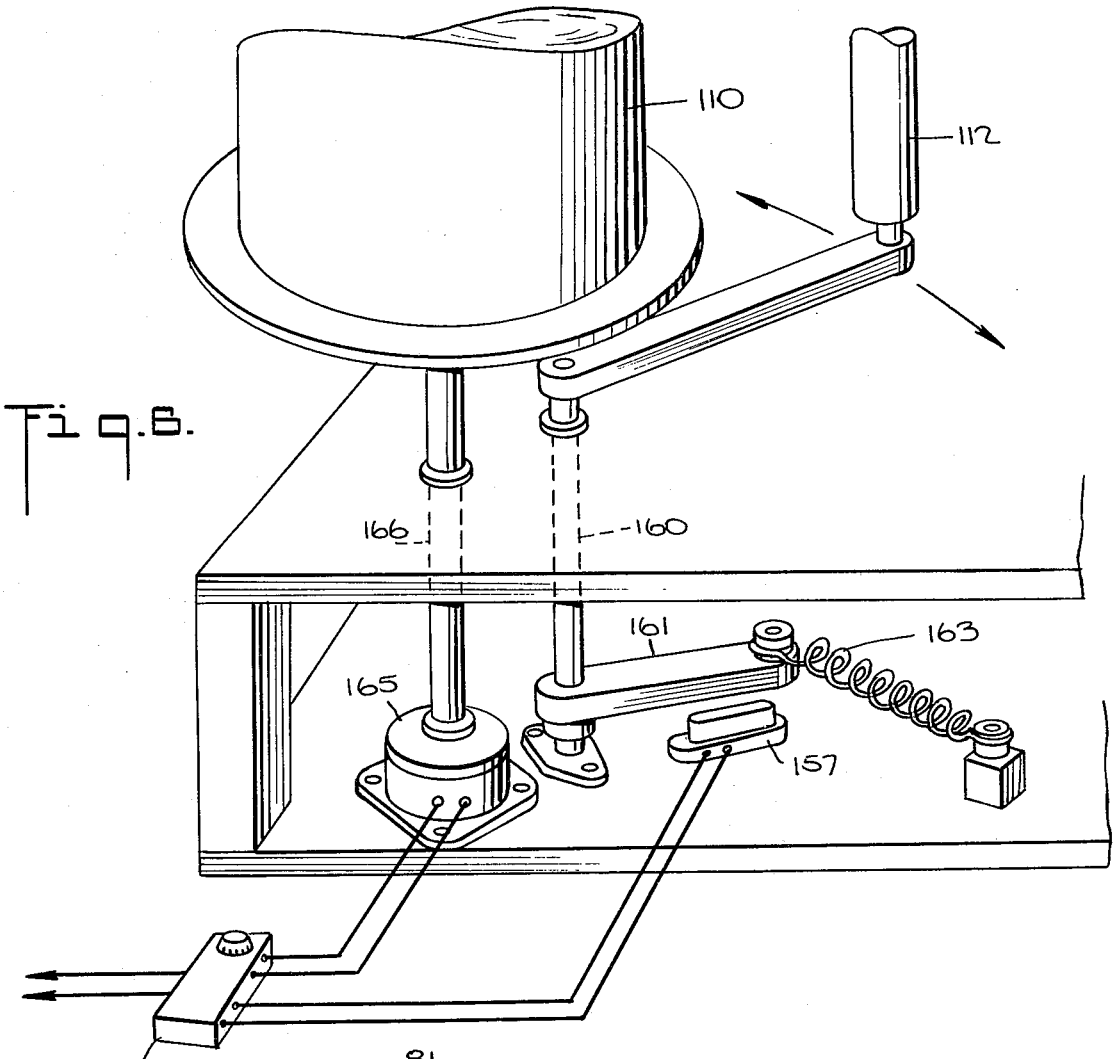
FIG. 6 is an enlarged perspective view of the label supply drum and the associated feed regulating means.

A constant amount of drag is imparted to the label supply wheel 110 by means of the dancer roll 112 and associated proximity switch 157. Specifically and with particular reference to FIGS. 6 and 8, dancer roll 112 is mounted to pivot about shaft 160 which has mounted at its base an arm member 161 which is movable over proximity switch 157. A spring 163 urges dancer roll 112 in a direction of maximum extension of the carrier web length from the supply wheel 110, i.e. in a position furthest away from the source of supply as measured along the web travel path. Disposed beneath arm member 161 is a magnetically activated proximity switch 157 which in turn regulates the degree of braking applied by brake 165 which is mounted on the web supply shaft 166. Potentiometer 167 is connected to web supply brake 165 and may be manually regulated to initially set the desired degree of braking. Subsequently, the movement of dancer roll 112 exerts a substantially constant force or drag on the web supply wheel 110.

A similar proximity switch 156 is provided for the rewind label roller 155. In this connection, dancer roll 153 includes a similar arm disposed over proximity switch 156. Proximity switch 156 however, is connected to clutch 170 which controls movement of take up reel 155 as will be more fully described hereinafter.

Rewind wheel 155 is driven directly by DC motor 70 through gear box 76. In this respect, output shaft 80 of gear box 76 is coupled to clutch 170 by means of the chain and sprocket drive 171. The output from clutch 170 is coupled to the rewind reel 155 by means of the chain and sprocket drive 172 (FIG. 4).

With reference to the drawings and particularly to FIGS. 4–8, the path of travel of label carrying web 12 is traced. Initially the web exits from the label supply wheel 110 and passes over idler roller 111. Dancer roll 112, which is movable from the solid position to the dotted position (FIG. 8), maintains a substantially constant drag on label supply wheel 110 by means of brake 165. After passing over dancer roll 112, the web is routed to metering roll 73 disposed adjacent to photocell 122. Feed of the web 12 is regulated by metering roll 73 which in turn is responsive to a signal from photocell 122 disposed adjacent thereto. As mentioned, metering roller 73 meters the web supply and is driven directly by the electric drive motor 70 via clutch 74 and the associated brake 73*a*.

After being dispensed from metering roll 73, the web then is routed over the adjustable roller 115 and then over idler rollers 125, 126, 127 and 128 and over preheater 130. Web 11 is next routed through the decorating station 20 at which point label 11 is applied to container 10. As mentioned, transfer roller 131 and 132 are operated in timed relation with respect to the registration marks with the transfer rollers moving sequentially into and out of engagement with the container 10 responsive to the movement of cams 81 and 81*a*. In this manner, exact registration is achieved and decoration of the container accomplished with the labels capable of being applied in a predetermined location with respect to the position of the seam.

Prior to the initial operation of the machine, adjustment screw 117 is employed to adjust the positioning of the label 12 with respect to the positioning of the conveyors. As mentioned, rotation of screw 117 causes a forward or rearward movement of roller 115 thus adjusting the label position at decorating station 20. Once manual adjustment is completed, automatic operation is maintained by means of the photocell 122 reading registration marks 13 as previously described.

A stepping motor is provided with its output shaft 180 coupled to gear box 71 by means of the chain and sprocket drive 181. Signals provided to the stepping motor, such as from photocell 122 thus provide for automatic web speed regulation.

As mentioned, the modular construction of the decorating apparatus of this invention allows for simultaneous decoration to two sides of the container. In this manner, different labels 11 may be applied to the front and back of the container 10. (See FIGS. 13, 14 and 15). Each of the modules including the label carrying webs 12 and transfer rollers are identical in construction and mirror images of one another. As shown in FIG. 13, adjacent modules are positioned in an oppositely facing relation and spaced from one another a distance approximately equal to the width of the article being decorated. The container conveying means, e.g. receptacles 30 on chain 32, are positioned between the spaced modules to facilitate two sided decorating of a non-circular article. When two sided decorating is desired the output shaft 79 of each module is coupled to one another. Thus, each module is provided with a separate motor 70 operated by a common potentiometer. It is also recognized that a single motor may be used to drive both modules.

The module is further provided with an adjustment mechanism so as to accommodate decoration of tapered containers. The entire module assembly including the drive system and web feed system, is capable of being adjusted by tilting the rearward portion upwardly within the slot 195 (FIG. 14) in support member 196. When the appropriate degree of inclination is achieved so as to have the transfer rollers 131 and 132 in contact with the article being decorated, fastener 197 is tightened and the system ready for use. As mentioned this may also be accomplished with two-sided decorating as in FIGS. 14 and 15. Also, one module may be utilized to decorate the tapered side of an irregular container while the other module is utilized to decorate the vertical side of the same container.

With particular reference to FIG. 16, an alternative embodiment is described which is particularly suitable for decorating tapered containers or other irregular shapes in which the size or shape of the top and bottom of the container are not the same. Although the particular structure will be described with respect to metallic transfer roller 132, it is noted that a similar means is provided on the adjacent transfer roller 131. In this embodiment, instead of being controlled by a single cam member, movement of transfer roller 132 is controlled by an upper cam member 200 and a lower cam member 201. Cam followers 202 and 203, engaging cam members 200 and 201 respectively, are connected to the upper and lower portions of transfer roller 132. Spring 138 is connected adjacent the approximate midpoint of roller 132 which is pivotally mounted on shaft 204. Thus, cams 200 and 201 independently of one another control the degree of inward movement of the transfer rollers. Such control permits the system to be employed in decorating containers of irregular shape and including the illustrated tapered container.

Thus, there has been described a method and apparatus which is suitable for accomplishing high speed heat transfer label decoration. Moreover, the articles being decorated are moved within the apparatus and decorated without any intermittent or other interruption of movement. The system is further suitable for multi-sided decoration of both regular and irregular shaped containers.

Although the above description is directed to the preferred embodiment of the invention, it is noted that other variations and modifications will be apparent to those skilled in the art, and may be made without departing from the spirit or scope of the present disclosure.

What is claimed is:

1. An apparatus for continuously applying heat transfer labels carried on a web to individual articles to be decorated at a decorating station which comprises:

conveying means for continuously carrying said articles to a decorating station;

a plurality of receptacle means disposed adjacent to said conveying means suitable for receiving and holding said articles as they pass through said decorating station;

means for continuously driving said receptacle means containing the article to be decorated therein through said decorating station;

means for driving said label carrying web through said decorating station;

means for heating the labels on said web prior to arrival at said decorating station;

means for engaging and inflating said article while at said decorating station;

means for urging said heated label into engagement with said article to be decorated at said decorating station; and means for conveying said decorated article away from said decorating station.

2. An apparatus in accordance with claim 1 which further includes a vacuum box disposed beneath said conveying means and wherein said conveying means includes a plurality of openings therein so as to enable a vacuum to be applied to the bottom of the article being carried on said conveying means.

3. An apparatus in accordance with claim 1 which further includes a feedscrew suitable for engaging the article to be decorated disposed adjacent to said conveying means so as to feed the articles to be decorated from said conveying means to said receptacle means in a spaced relation.

4. An apparatus in accordance with claim 1 wherein said means for urging said heated label into engagement with said article comprises a pair of spaced heated transfer rollers adapted to move into and out of engagement with said label carrying web.

5. An apparatus in accordance with claim 4 wherein said spaced transfer rollers comprise a first resilient surface roller and a second metallic roller, said resilient surface roller being maintained at a temperature sufficient to cause transfer of said label to said article to be decorated while said metallic roller is maintained at a temperature sufficient to effect release of said label from said web.

6. An apparatus in accordance with claim 5 wherein said metallic roller comprises a copper roller having a layer of chrome plating on the outer surface thereof.

7. An apparatus in accordance with claim 4 wherein said first roller is heated to a surface temperature of approximately 130°-250° F. and said second roller is heated to a surface temperature of approximately 500°-600° F.

8. An apparatus in accordance with claim 1 which further includes sensing means for regulating the speed of said label driving means so as to synchronize the speed of said label carrying web with that of said articles passing through said decorating station.

9. An apparatus in accordance with claim 1 suitable for decorating a non-circular article and which further includes a pair of label carrying webs, each of said webs being routed to said decorating station so as to engage and decorate opposite sides of said article to be decorated.

10. An apparatus in accordance with claim 1 which further includes a vertically disposed endless support belt having the face thereof in engagement with and supporting the article to be decorated at said decorating station.

11. An apparatus in accordance with claim 1 wherein the decorating station of said apparatus is provided in a modular package and a similar modular apparatus including a second label carrying web is disposed adjacent thereto so as to enable simultaneous decoration of two sides of an article.

12. An apparatus in accordance with claim 1 wherein said decorating station including said label carrying web is supported by a frame assembly having a pivotally mounted support section to enable pivotal movement of said decorating station and said label carrying web so as to accommodate the decoration of articles having tapered side wall portions.

13. An apparatus for applying a heat transferable label onto an article to be decorated at a decorating station which comprises a label carrying web including thereon a plurality of heat transferable labels routed through said decorating station;

a pair of movable transfer rollers spaced adjacent to one another along the path of travel of the web and disposed at said decorating station, said spaced transfer rollers comprising a first resilient surface roller and a second metallic roller, said resilient surface roller being maintained at a temperature sufficient to cause transfer of said label to said article to be decorated while said metallic roller is maintained at a temperature sufficient to effect release of said label from said web;

heating means disposed adjacent the path of said label carrying web for heating said web upstream of said pair of transfer rollers; and means for moving each of said pair of transfer rollers into and out of engagement with said article at said decorating station so as to cause the transfer of a label onto the article to be decorated.

14. The apparatus of claim 13 wherein said moving means includes for each of said pair of transfer rollers a rotatable cam member, a cam follower in engagement with said rotatable cam and having the fixed end thereof coupled to one of said pair of transfer rollers, and biasing means urging said transfer roller away from said decorating station until said cam follower engages a predetermined portion of said cam so as to urge said transfer roller into engagement with said article.

15. The apparatus of claim 14 wherein said heating means comprises a pivotally mounted heat platen movable into and out of engagement with said label carrying web and having said first resilient roller housed therein, said heat platen having the upstream end thereof pivotally mounted and the other end thereof including said rotatable cam follower.

16. An apparatus in accordance with claim 13 wherein said second roller comprises a copper roller having a layer of chrome plating on the outer surface thereof.

17. An apparatus in accordance with claim 13 wherein said first roller is heated to a surface temperature of approximately 130°-250° F. and said second roller is heated to a surface temperature of approximately 500°-600° F.

18. The apparatus of claim 14 which further includes a variable speed drive motor for driving each of said rotatable cam members, each of said cam members being mounted on a common shaft and means connecting said drive motor to said common shaft.

19. An apparatus for applying a transferable label onto a tapered article to be decorated at a decorating station which comprises a label carrying web including thereon a plurality of transferable labels routed through said decorating station;

a movable transfer roller disposed adjacent said decorating station;

a pair of rotatable cam members mounted above one another on a common shaft each having a predetermined contour adapted to move said transfer roller into and out of engagement with the tapered article at said decorating station;

drive means connected to said rotatable cam members;

an upper cam follower connected at one end thereof to the upper portion of said transfer roller and at the other end thereof in engagement with the upper of said rotatable cam members;

a lower cam follower connected at one end thereof to the lower portion of said transfer roller and at the other end thereof in engagement with the lower of said rotatable cam members; and pivot means connected to said transfer roller and about which said transfer roller may move into and out of engagement with said tapered article at said decorating station, the motion of the upper portion of said transfer roller being controlled by said upper cam member and the motion of the lower portion of said transfer roller being controlled by said lower cam member thereby enabling the decoration of tapered articles.

20. An apparatus in accordance with claim 19 which further includes biasing means urging said transfer roller away from said decorating station until said cam follower engages a predetermined portion of said cam so as to urge said transfer roller into engagement with said article.

21. An apparatus for applying a heat transferable label onto a tapered article to be decorated at a decorating station which comprises a label carrying web including thereon a plurality of heat transferable labels routed through said decorating station;

a pair of spaced movable transfer rollers disposed adjacent one another at said decorating station;

a pair of rotatable cam members mounted above one another on a common shaft associated with each of said transfer rollers, each of said pair of rotatable cam members having a predetermined contour adapted to move the respective transfer roller into and out of engagement with the tapered article at said decorating station;

heating means disposed adjacent the path of said label carrying web upstream of said pair of transfer rollers;

drive means connected to each of said pair of rotatable cam members;

each of said pair of rotatable cam members having associated therewith an upper cam follower connected at one end thereof to the upper portion of the respective transfer roller and at the other end thereof in engagement with the upper of said rotatable cam members associated with said transfer roller;

a lower cam follower connected at one end thereof to the lower portion of the respective transfer roller and at the other end thereof in engagement with the lower of said rotatable cam members associated with said transfer roller; and pivot means connected to each of said transfer rollers and about which each of said transfer rollers may move into and out of engagement with said tapered article at said decorating station, the motion of the upper portion of each of said transfer rollers being controlled by the respective upper cam member and the motion of the lower portion of each of said transfer rollers being controlled by the respective lower cam thereby enabling the decoration of a heat transferable label onto a tapered article.

22. An apparatus in accordance with claim 21 which further includes biasing means urging each of said transfer rollers out of engagement from said web until said cam follower engages a predetermined portion of said cam so as to urge each of said pair of transfer rollers into engagement with said label carrying web.

23. An apparatus in accordance with claim 22 wherein said spaced transfer rollers comprise a first resilient surface roller and a second metallic roller, said resilient surface roller being maintained at a temperature sufficient to cause transfer of said label to said article to be decorated while said metallic roller is maintained at a temperature sufficient to effect release of said label from said web.

24. The apparatus of claim 21 wherein said heating means comprises a pivotally mounted heat platen movable into and out of engagement with said label carrying web and having said first resilient roller housed therein, said heat platen having the upstream end thereof pivotally mounted and the other end thereof including said rotatable cam follower.

25. An apparatus in accordance with claim 23 wherein said second roller comprises a copper roller having a layer of chrome plating on the outer surface thereof.

26. An apparatus in accordance with claim 23 wherein said first roller is heated to a surface temperature of approximately 130°-250° F. and said second roller is heated to a surface temperature of approximately 500°-600° F.

27. A method of continuously decorating a series of articles with heat transferable labels which comprises the steps of:

feeding the articles in a spaced relationship to an article engaging receptacle;

engaging the bottom of the article in a holding relationship with the receptacle;

engaging the upper portion of the article with an article inflating means while the bottom of the article is held in the article engaging receptacle;

conveying the article engaged at the upper and lower portions thereof to a decorating station;

routing a release coated label carrying web to the decorating station;

preheating the label carrying web prior to arrival at the decorating station;

synchronizing the speed of the label carrying web with that of the means for conveying the article to the decorating station;

further synchronizing the movement of a pair of spaced transfer rollers into and out of engagement with the article at the decorating station;

moving the first of the label engaging transfer rollers into engagement with the label so as to heat the label to a temperature sufficient to cause transfer of the label to the article being decorated;

moving the second of the label engaging transfer rollers into engagement with the label so as to heat the label to a temperature sufficient to release the label from the web;

withdrawing the pair of transfer rollers out of engagement with the label carrying web; and removing the decorated article from the decorating station.

28. The method of claim 27 wherein the step of engaging the bottom of the article includes the steps of first engaging the leading end of the bottom of the article to be decorated with the leading end of the receptacle, and raising the trailing end of the receptacle into a holding engagement with the bottom of the article to be decorated.

29. The method of claim 27 wherein the step of engaging the upper portion of the article includes the step of gradually lowering a cup shaped receptacle into operative connection with the open end of the article to be decorated.

30. The method of claim 27 which further includes the step of supporting the article being decorated at the side opposite that being decorated.

31. The method of claim 27 which further includes the steps of routing a second release coated label carrying web to the decorating station;

preheating said second label carrying web prior to arrival at the decorating station;

synchronizing the speed of the second label carrying web with that of the means for conveying the article to the decorating station;

further synchronizing the movement of a second pair of spaced transfer rollers into and out of engagement with the article at the decorating station;

moving the first of the second pair of label engaging transfer rollers into engagement with the label on the second web so as to heat the label to a temperature sufficient to cause transfer of the label to a second side of the article being decorated;

moving the second of the second pair of label engaging transfer rollers into engagement with the label on the second web so as to heat the label to a temperature sufficient to release the label from the web; and withdrawing the second pair of transfer rollers out of engagement with the article.

32. An apparatus for continuously applying heat transferable labels carried on a web to opposite sides of individual articles to be decorated at a decorating station which comprises a pair of label carrying webs each including thereon said labels to be applied to the articles to be decorated;

means for driving the first label carrying web through said decorating station;

means for driving a second label carrying web through said decorating station with the labels thereon disposed in an oppositely facing position with respect to those of said first web, said second label carrying web being routed through said decorating station at a distance spaced from the path of said first web approximately equal to the width of the article to be decorated;

conveying means disposed adjacent said decorating station adapted to deliver the articles to be decorated into position between said label carrying webs;

a plurality of receptacle means disposed adjacent said conveying means suitable for receiving and supporting said articles as they pass through said decorating station;

means for engaging the upper portion of said article being conveyed from said decorating station; and means for conveying the decorated article away from said decorating station.

33. An apparatus in accordance with claim 32 which further includes means for heating each of said label carrying webs prior to arrival at said decorating station.

34. An apparatus in accordance with claim 32 wherein said engaging means further includes means for inflating said article to be decorated while at said decorating station.

35. An apparatus in accordance with claim 32 which further includes a feedscrew suitable for engaging the article to be decorated disposed adjacent to said conveying means so as to feed the articles to be decorated from said conveying means to said receptacle means in a spaced relation.

36. An apparatus in accordance with claim 32 wherein each of said label carrying webs is supported in a frame assembly having a pivotally mounted support section to enable pivotal movement of said label carrying webs so as to accommodate the decoration of articles having tapered side wall portions.

37. An apparatus in accordance with claim 32 wherein each of said label carrying webs is housed in a separate frame assembly including therein individual drive motors, and which further includes means coupling said drive motors to one another in order to facilitate synchronized timing of each of said label carrying webs.

* * * * *